US010869526B2

(12) United States Patent
Zahradka

(10) Patent No.: US 10,869,526 B2
(45) Date of Patent: Dec. 22, 2020

(54) SLIDE CLOSURE WITH STABILIZING FINS AND ASSOCIATED GARMENT

(71) Applicant: TARGET BRANDS, INC., Minneapolis, MN (US)

(72) Inventor: Sarah Jane Zahradka, Saint Paul, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 44 days.

(21) Appl. No.: 16/240,060

(22) Filed: Jan. 4, 2019

(65) Prior Publication Data

US 2020/0214401 A1 Jul. 9, 2020

(51) Int. Cl.
*A44B 19/34* (2006.01)
*A41D 1/02* (2006.01)

(52) U.S. Cl.
CPC ..... *A44B 19/34* (2013.01); *A41D 1/02* (2013.01); *A41D 2300/322* (2013.01)

(58) Field of Classification Search
CPC .... A44B 19/34; A41D 1/02; A41D 2300/322; Y10T 24/2511; A41H 37/06
See application file for complete search history.

(56) References Cited

U.S. PATENT DOCUMENTS 2,103,037 A 12/1937 Marinsky
2,273,773 A 2/1942 Poux
2,677,952 A 5/1954 Stue
2,688,138 A 9/1954 Glass
2,728,125 A 12/1955 Wild
2,800,699 A 7/1957 Armstrong
2,836,872 A 6/1958 Luglio
3,435,489 A 4/1969 Morin
3,852,851 A 12/1974 Higuchi et al.
3,900,926 A 8/1975 Takahashi et al.
4,660,874 A 4/1987 Rifkin
4,870,724 A * 10/1989 Fujisaki ..... A44B 19/38 24/433
6,112,376 A 9/2000 Akashi et al.
6,490,769 B2 12/2002 Siegel
6,775,885 B1 8/2004 Wang
6,865,782 B2 3/2005 Takazawa et al.
7,669,296 B2 3/2010 Yokoyama et al.
7,921,526 B2 4/2011 Wangbunyen
8,020,261 B2 9/2011 Takani et al.
(Continued)

*Primary Examiner* — Robert Sandy
*Assistant Examiner* — Louis A Mercado
(74) *Attorney, Agent, or Firm* — JoAnn M. Seaton; Griffiths & Seaton PLLC

(57) ABSTRACT

A slidable closure includes a first fastener tape and a second fastener tape and a stabilizing fin. A first row of fastener elements extends along a first fastener tape longitudinal edge. A retainer box is positioned near first fastener tape bottom edge and adjacent a bottom fastener element of the first row of fastener elements. A second row of fastener elements extends along a second fastener tape longitudinal edge and is configured to selectively interlock with the first row of fastener elements. An insertion pin is positioned near the second fastener tape bottom edge. The stabilizing fin is more rigid than the first fastener tape and is substantially planar. The stabilizing fin is coupled with the first fastener tape to extend upwardly from a first fastener tape bottom edge and defines a first edge closest to the first row of fastener elements.

18 Claims, 10 Drawing Sheets

(56) References Cited

U.S. PATENT DOCUMENTS

| | | | |
|---|---|---|---|
| D673,414 | S | 1/2013 | Sanders |
| 8,341,809 | B2 | 1/2013 | Damon et al. |
| 9,706,816 | B2 | 7/2017 | Coakley et al. |
| 2004/0181920 | A1 | 9/2004 | Mizuhara et al. |
| 2017/0135447 | A1 | 5/2017 | Tamura et al. |

* cited by examiner

SLIDE CLOSURE WITH STABILIZING FINS AND ASSOCIATED GARMENT

BACKGROUND OF THE INVENTION

Slidable closures, such as zippers, are commonly used to selectively fasten opposing fabric portions to one another. Slidable closures are often used to close two separate fabric portions on the front of a garment, such as a sweatshirt, coat, jacket, or similar, while still allowing for ready uncoupling and opening of such garment.

To close a garment front with a known open zipper arrangement, a wearer typically moves a slider to the bottom of the zipper and positions it immediately above a zipper retaining box on a common side of the zipper. Then, the wearer moves a small insertion pin on the other side of the zipper through the slider and into the retaining box of the zipper. Once the insertion pin has engaged the retainer box, the wearer pulls upwardly on the slider to move the slider up the zipper. Moving the slider up the zipper, brings teeth on opposite sides of the zipper together and forces the teeth into interlocking engagement with each other closing the garment front.

The insertion pin and retaining box are quite small and proper alignment for closure is often difficult, especially when the garment is bulky, such as a winter coat. Difficulties in sliding the insertion pin into the retail box are additionally amplified when the wearer has impeded contact with the retaining box and the insertion pin, such as when wearing gloves or mittens. Users with mobility limiting medical conditions, disabilities, and/or limited dexterity due to age, that is, the young or old, may also have increased difficulty coupling the insertion pin and the retaining box. In addition, when the zipper is located at a bottom of a garment, it may be difficult for a wearer to see the insertion pin and retaining box for coupling due to poor eyesight or impedance by the coat or other garment itself.

SUMMARY

A slidable closure includes a first fastener tape, a second fastener tape, and a stabilizing fin. The first fastener tape defines a first fastener tape bottom edge and a first fastener tape longitudinal edge. The second fastener tape defines a second fastener tape bottom edge and a second fastener tape longitudinal edge. A first row of fastener elements extends along the first fastener tape longitudinal edge, and a retainer box is positioned near first fastener tape bottom edge and adjacent a bottom fastener element of the first row of fastener elements. A second row of fastener elements extends along the second fastener tape longitudinal edge and is configured to selectively interlock with the first row of fastener elements, and an insertion pin is positioned near the second fastener tape bottom edge and adjacent a bottom of the second row of fastener elements. The stabilizing fin is more rigid than the first fastener tape and is substantially planar. The stabilizing fin is coupled with the first fastener tape to extend upwardly from the first fastener tape bottom edge and defines a first edge closest to the first row of fastener elements. The first edge is spaced from the first row of fastener elements and from the retainer box. Other closures and associated garments are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" or "substantially" apply to all numeric values or descriptive terms, respectively, and generally indicate a range of numbers or characteristics that one of skill in the art would consider equivalent to the recited values or terms, that is, having the same function or results.

This innovation provides a slidable closure including stabilizing fins extending along a bottom portion of the slidable closure to assist a user in coupling bottom ends of the slidable closure, such as a zipper, to one another to ready the slidable closure for closure. The stabilizing fins are substantially planar, for example, formed of a dense plastic sheet material and are oversized as compared to other rigid portions of slidable closure, such as a retainer box, a slider, a fastening element, etc., providing a stiffness and rigidity to a fabric body of a garment or other article near a free end of the slidable closure to assist in aligning the free ends of slidable closure for coupling. For example, where slidable closure is a zipper, stabilizing fins prevent undesired shifting of the fabric body adjacent a retainer box and an insertion pin of a zipper, so that a wearer can more easily slide insertion pin into the retainer box positioning the zipper slider to be pulled up to close the zipper and a corresponding opening of the garment or other article. In one example, the fabric body substantially encloses the stabilizing fins such that the stabilizing fins are not readily visually perceived by a wearer or those around him or her.

Figure 1:
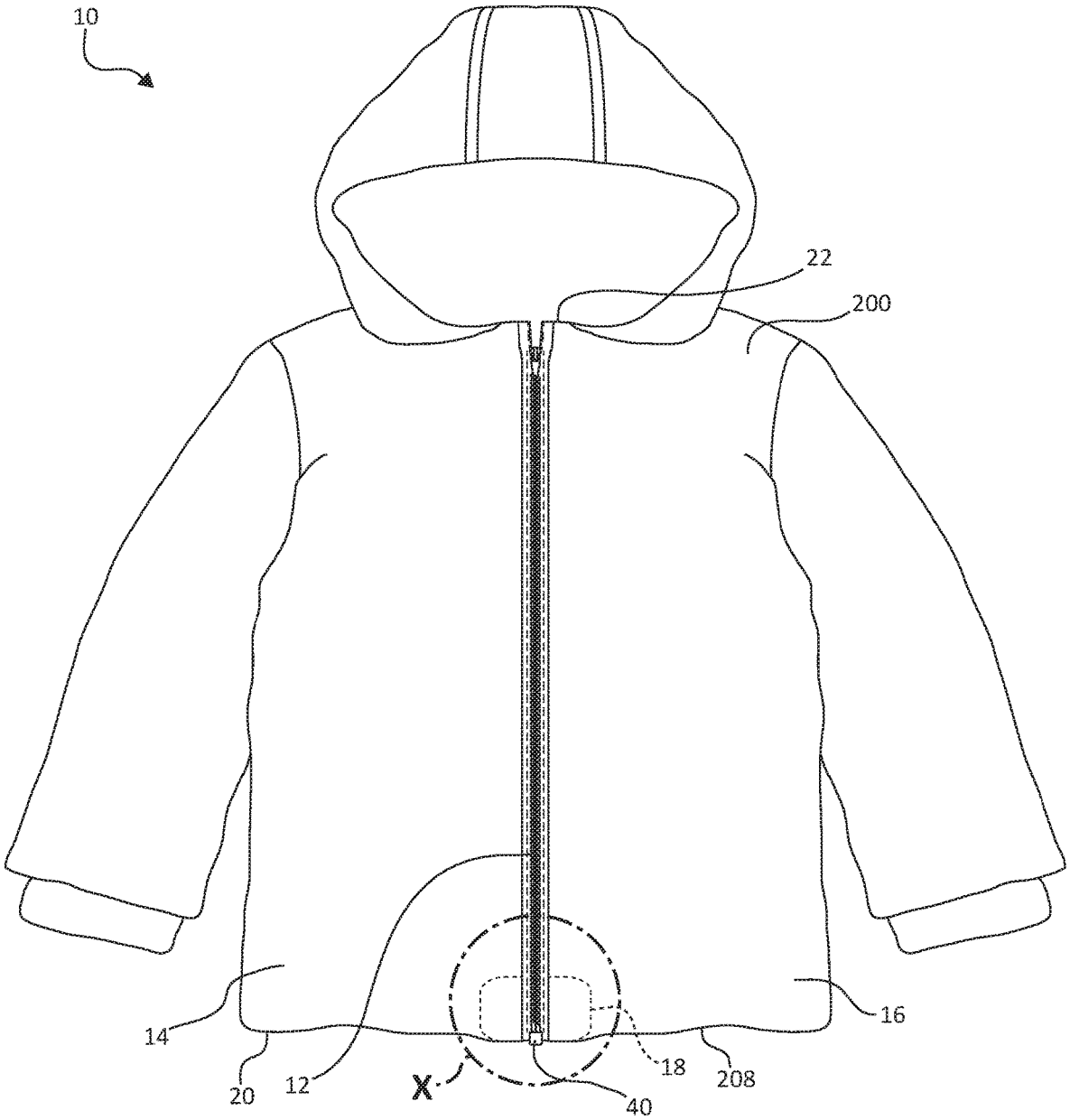
FIG. 1 is a front view illustration of a garment with slidable closure, according to one embodiment of the present invention.
Figure 2:
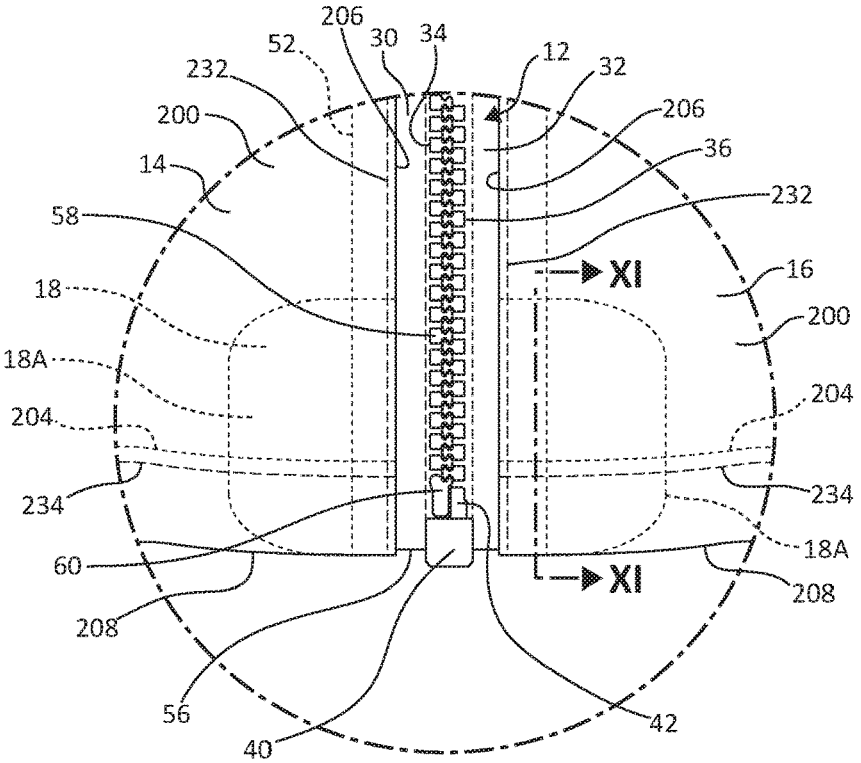
FIG. 2 is a detail front view illustration of a portion of the garment of FIG. 1, according to one embodiment of the present invention.
Figure 3:
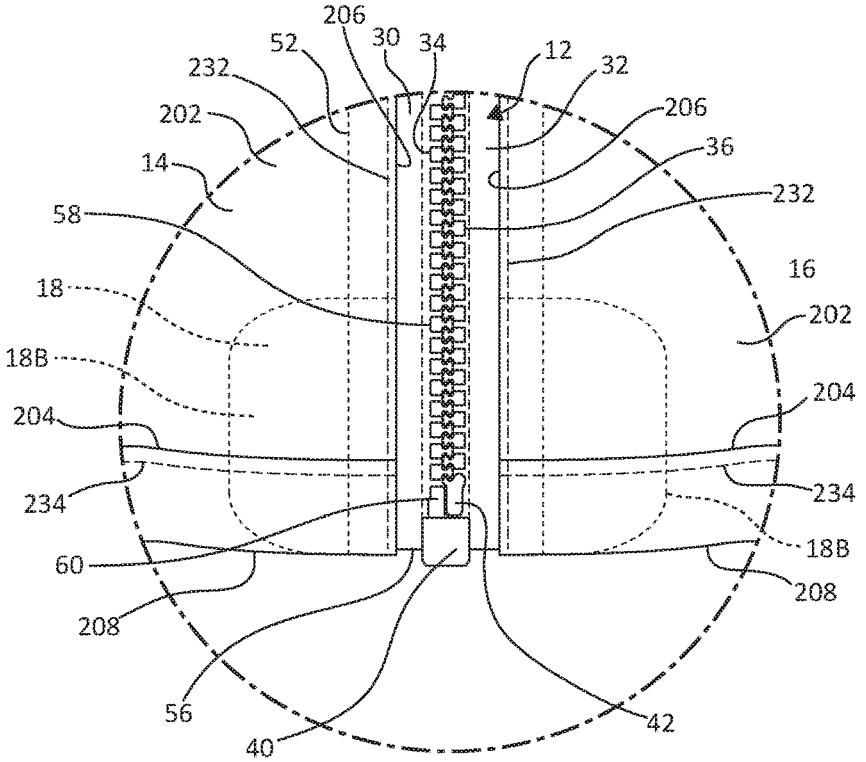
FIG. 3 is a detail rear view illustration corresponding with the detail front view illustration of FIG. 2, according to one embodiment of the present invention.
Figure 4:
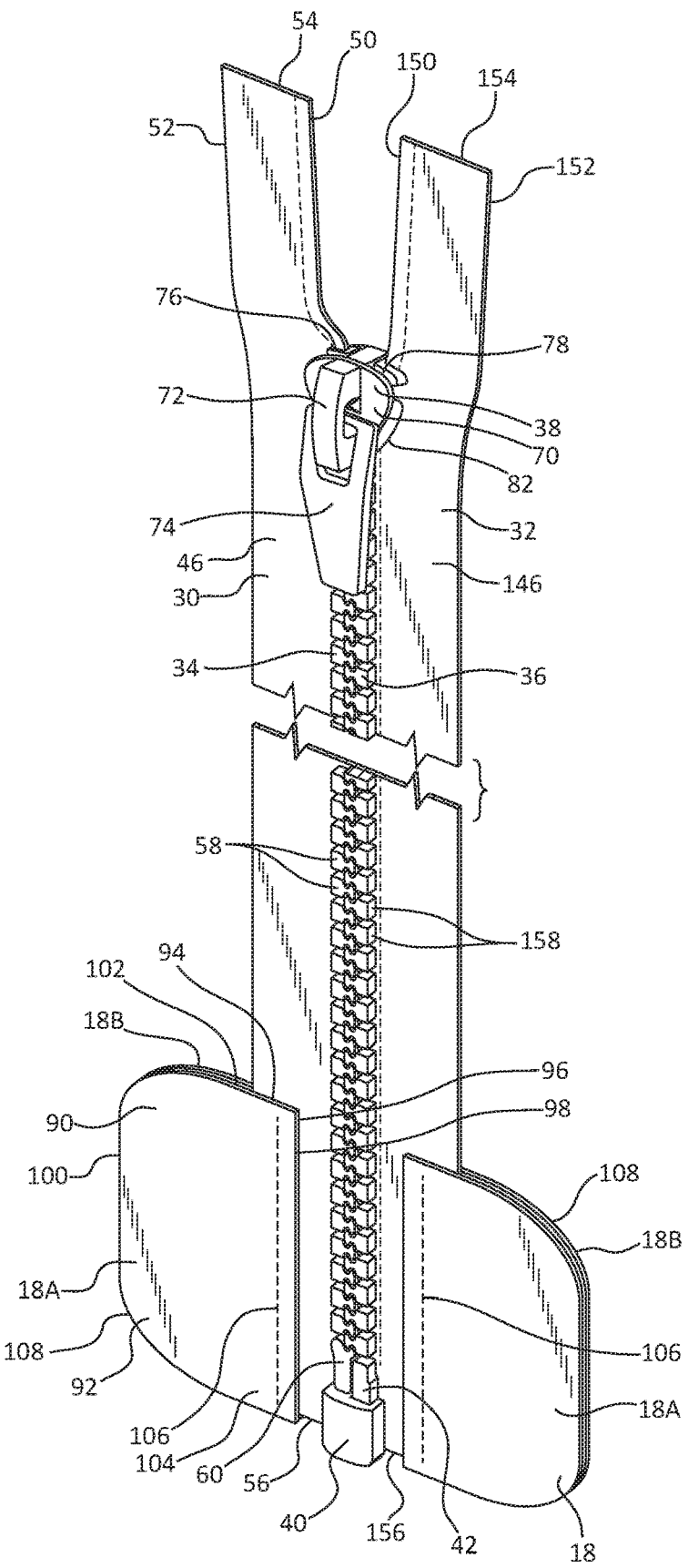
FIG. 4 is a front, perspective view illustration of the slidable closure of FIG. 1, according to one embodiment of the present invention.
Figure 5:
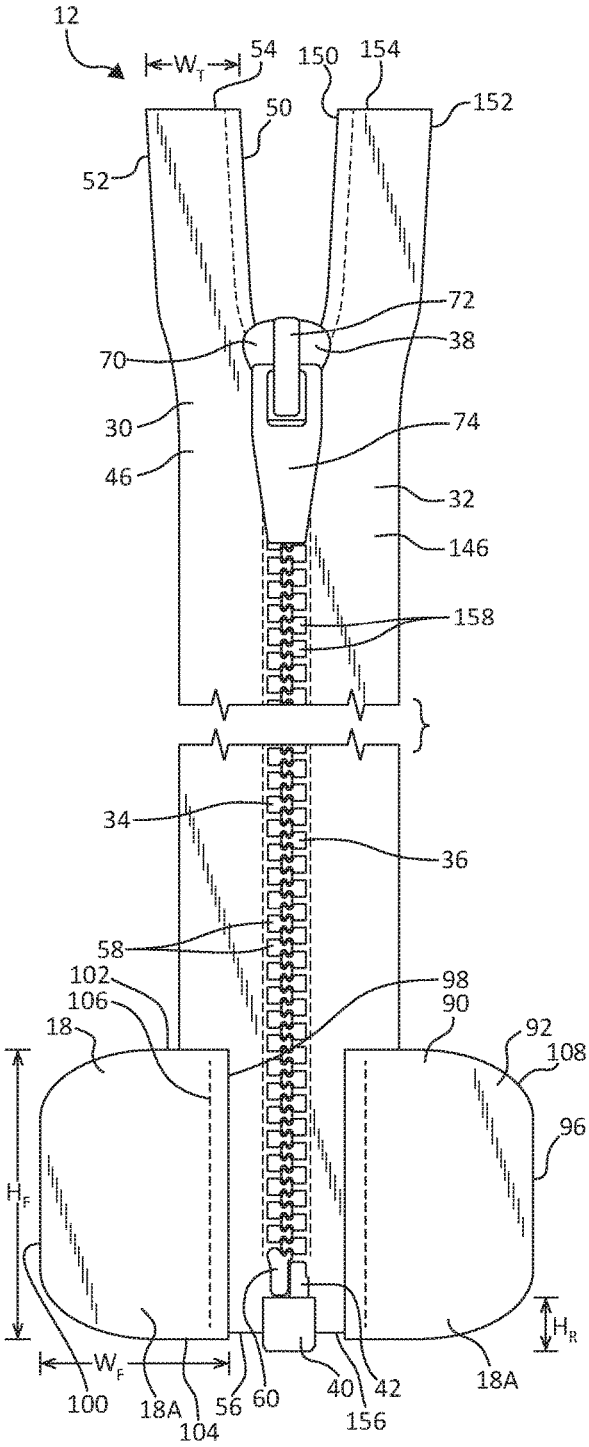
FIG. 5 is a front view illustration of the slidable closure of FIG. 3, according to one embodiment of the present invention.
Figure 6:
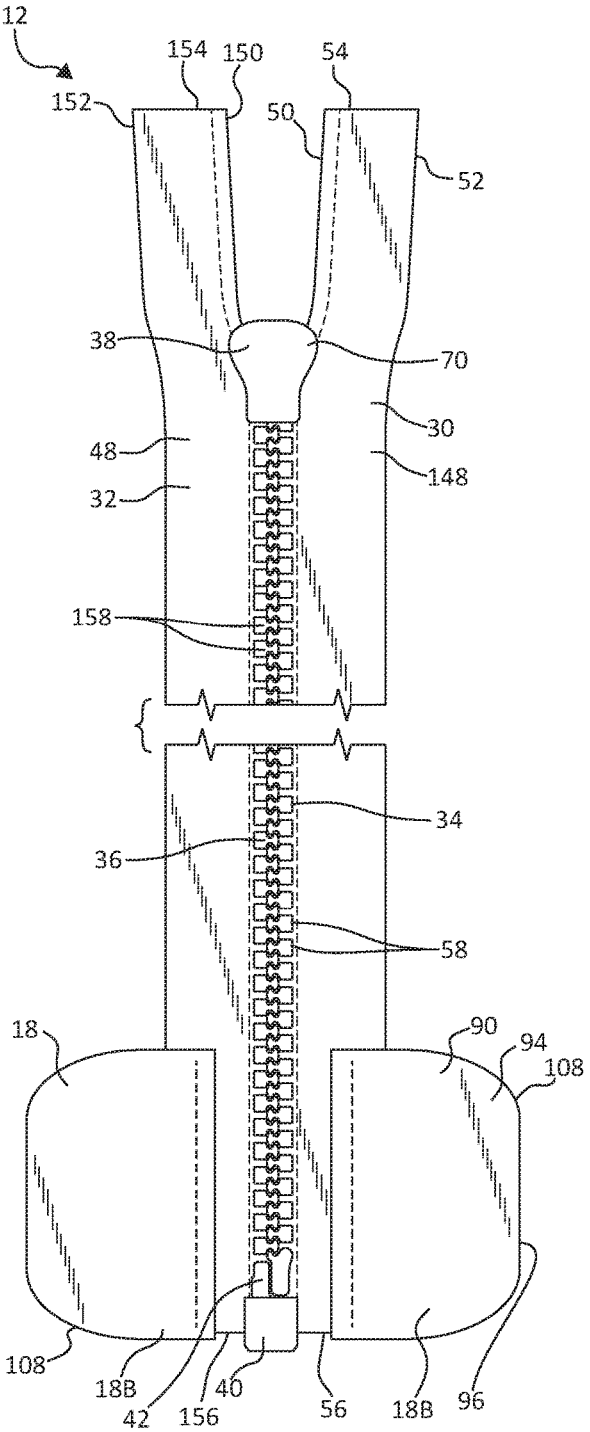
FIG. 6 is a rear view illustration of the slidable closure of FIG. 3, according to one embodiment of the present invention.
Figure 7:
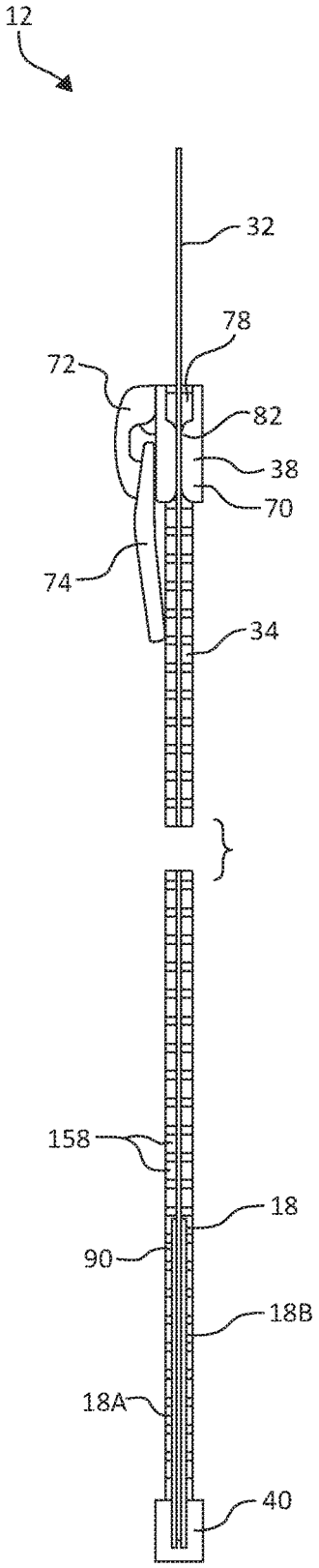
FIG. 7 is a right side view illustration of the slidable closure of FIG. 3, according to one embodiment of the present invention.
Figure 8:
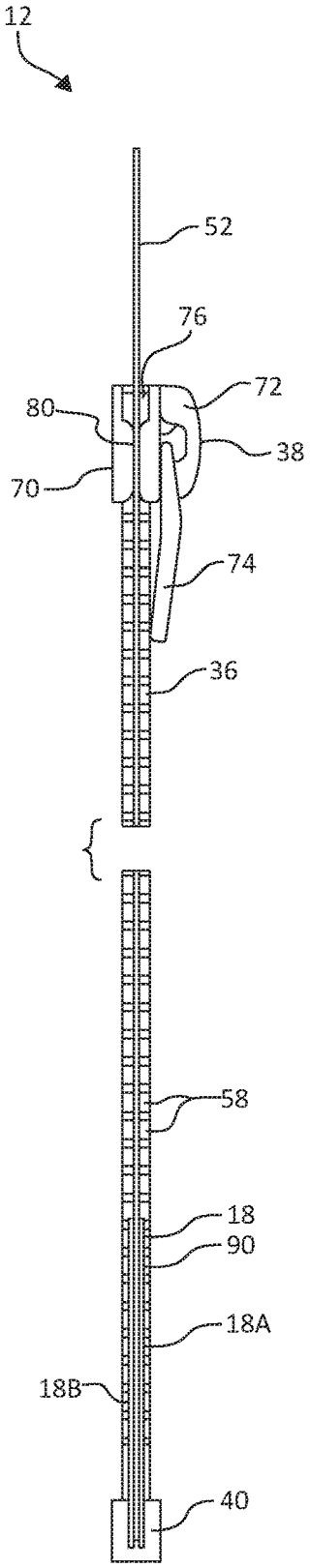
FIG. 8 is a left side view illustration of the slidable closure of FIG. 3, according to one embodiment of the present invention.
Figure 9:
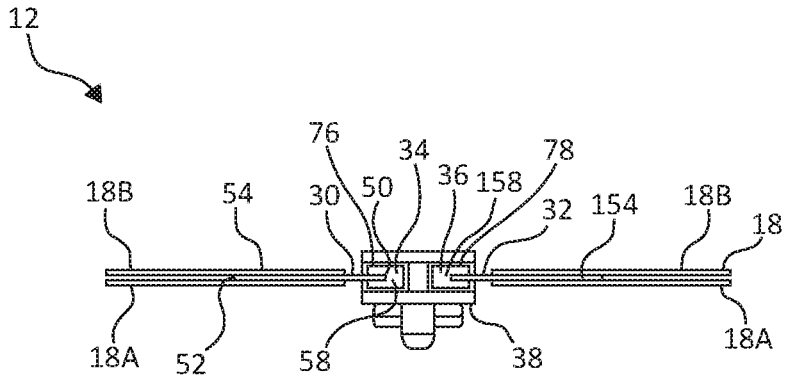
FIG. 9 is a top view illustration of the slidable closure of FIG. 3, according to one embodiment of the present invention.
Figure 10:
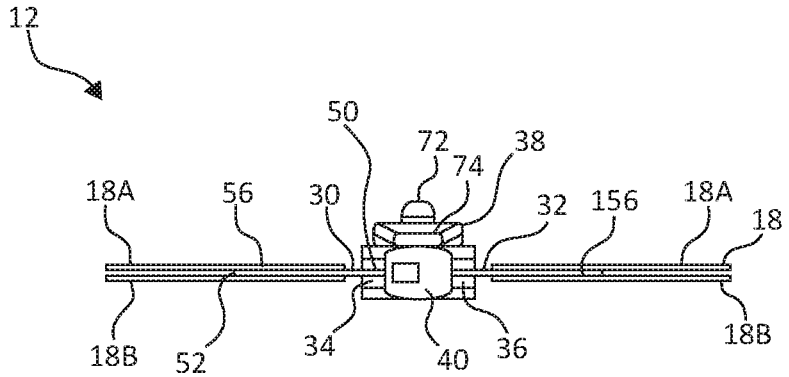
FIG. 10 is a bottom view illustration of the slidable closure of FIG. 3, according to one embodiment of the present invention.

Turning to the Figures, FIG. 1-3 illustrates a fabric article, more specifically, a garment 10 with a slidable closure 12 for opening and closing garment 10. Slidable closure 12 is provided with stabilizing fins 18 to aid a wearer in using slidable closure 12, as will be described in further detail below. Garment 10 is any suitable fabric item, such as an article of clothing, namely, one of a jacket, a coat, a sweatshirt, a vest, coat, shirt, pants, or any other garment or other articles, such as bags shoes, tents, etc., that may have one or more portions with edges to be releasably coupled together with slidable closure 12. In one embodiment, garment 10 includes a first front side 14 and a second front side 16 to be selectively coupled together with slidable closure 12. In one example, slidable closure 12 is coupled, for example, sewn to each of first front side 14 and second front side 16 from a bottom edge 20 to a top edge 22 of garment 10. While slidable closure 12 is shown here as coupling fronts of garment 10, in other embodiments slidable closure 12 is placed at any location on garment 10 where edges of two garment portions will be releasably coupled together.

FIGS. 4-10 illustrate one embodiment of slidable closure 12 in the form of a mechanical zipper. Other suitable slidable closures are also contemplated such a magnetic zipper or slot and grove coupling as will be apparent to those of skill in the art upon reading the present application. Slidable closure 12, in the illustrated embodiment, includes a first fastener tape 30, a second fastener tape 32, a first row of fastener elements 34, a second row of fastener elements 36, a slider 38, a retaining box 40, and an insertion pin 42. Each of first fastener tape 30 and second fastener tape 32 are formed of a suitable and flexible fabric. In one example, first fastener tape 30 is substantially planar defining a front surface 46 and a rear surface 48 opposite front surface 46. First fastener tape 30 defines a first longitudinal edge 50 configured to be positioned closest to second fastener tape 32, a second longitudinal edge 52 opposite first longitudinal edge 50, a top edge 54 extending between first longitudinal edge 50 and second longitudinal edge 52, and a bottom edge 56 extending between first longitudinal edge 50 and second longitudinal edge 52 opposite top edge 54. First row of fastener elements 34 extends along and over a substantially entirety of first longitudinal edge 50. In one embodiment, first row of fastener elements 34 can take various forms, such as where each fastener element is a zipper tooth 58.

Slider 38 is placed on to slidably move up and down first row of fastener elements 34. In one example, slider 38 includes a primary body 70, a bridge 72 extending forwardly from primary body 70, and a pull 74 coupled to bridge 72. Primary body 70 includes a first channel 76 and a second channel 78 each extending to be open at a top and a bottom thereof. First channel 76 and second channel 78 are positioned to angle toward one another as they extend from a top of primary body 70 to a bottom of primary body 70. A first slot 80 extends along a side of primary body 80 and to be in communication with first channel 76 along an entire length thereof. A second slot 82 extends along a side of primary body 80 opposite first slot 80 to be in communication with second channel 76 along an entire length thereof. Slider 38 is positioned such that first channel 76 receives a portion of first row of fastener elements and first fastener tape 30 extends through first slot 80. Slider 38 is configured to move up and down first row of fastener elements 34 along first side edge 40 of first fastener tape 30.

Bridge 72 extends from primary body 70 on a front side of front surface 46 of first fastener tape 30. Pull 74 is coupled to bridge 72, in one example, to allow pull 74 to rotate relative to bridge 72. Pull 74 provides a portion of slidably retainer that is easier to grasp by a wearer such that the wearer can pull upwardly on pull 74 to pull slider 38 up and pull downwardly on pull 74 to pull slide 38 down.

Retainer box 40 is located at a corner of first fastener tape 30 formed at the intersection of first longitudinal edge 50 and bottom edge 56, in one embodiment. Retainer box 40 extends beyond first longitudinal edge 50 away from second longitudinal edge 52 to define a pin retaining cavity 64 and a groove 62 coupled thereto open to a top and side of retainer box 40. A retainer pin 60 extends from retainer box 40 and is in line with first row of fastener elements 34, where retainer pin 60 is positioned adjacent, for example, just below a bottommost tooth 58 of first row of fastener elements 34, in a position to be selectively received by first channel 76 of slider 38. Retainer box 40 serves as a stop for slider 38 to keep slider 38 from sliding off a bottom of first fastener tape 30 and a registration means for aligning second row of fastener elements 36 with first row of fastener elements 34 for interlocking and closing of garment 10.

In one example, second fastener tape 32 is substantially planar defining a front surface 146 and a rear surface 148 opposite front surface 146. Second fastener tape 32 defines a first longitudinal edge 150 configured to be positioned closest to first fastener tape 30, a second longitudinal edge 152 opposite first longitudinal edge 150, a top edge 154 extending between first longitudinal edge 150 and second longitudinal edge 152, and a bottom edge 156 extending between first longitudinal edge 150 and second longitudinal edge 152 opposite top edge 154. Second row of fastener elements 36 extends along and over a substantially entirety of first longitudinal edge 150. In one embodiment, second row of fastener elements 36 can take various forms, such as where each fastener element is a zipper tooth 158.

Insertion pin 42 is coupled to second fastener tape 32 at a corner of second fastener tape 32 formed at the intersection of first longitudinal edge 150 and bottom edge 156, and, in one example, extends below bottom edge 156. Insertion pin 42 is sized and shaped to be slidably and selectively received in second channel 78 of slider 38. More specifically, insertion pin 42 is configured to slide through second channel 78 of slider 38, when slider 38 is positioned immediately adjacent retainer box 40, and into pin retaining cavity 64 such that first fastener tape 30 extends outwardly therefrom through groove 62 of retainer box 40. When insertion pin 42 is in groove 62 and second channel 78 slidable closure 12 is properly aligned for slider 38 to be able to be slide up first row of fastener element elements 34 and second row of fastener elements 36. Notably, insertion pin 42 is generally elongated to match a retainer (not shown) of groove 62 and is of fairly small size.

Due to the convergence of first channel 76 and second channel 78 as considered from a top to a bottom of slider 38, movement of slider 38 upwardly from retainer box 40, simultaneously pulls adjacent portions of first row of fastener element elements 34 a second row of fastener elements 36 together into interlocking engagement with each other. Also due to the divergence of first channel 76 and second channel 78 as considered from a bottom to a top of slider 38, movement of slider 38 upwardly from retainer box 40, simultaneously pulls adjacent portions of first row of fastener element elements 34 a second row of fastener elements 36 together to interlock with each other.

In one embodiment, stabilizing fins 18 are coupled to bottoms of first fastener tape 30 and second fastener tape 32 to more rigidly present the bottoms of first fastener tape 30 and second fastener tape 32 making selective mating of insertion pin 42 and retainer box 40 considerably easier than in the prior art. In one example, stabilizing fins 18 are sufficiently rigid and coupled in sufficient proximity to first fastener tape 30 and second fastener tape 32 that a user can manipulate positioning of insertion pin 42 and retainer box 40 via interaction with the corresponding stabilizing fins 18, as will be apparent to those of skill in the art upon reading this application. In one example, each of stabilizing fins 18 are substantially identically sized and shaped and are formed of a common material, while in other example, stabilizing fins 18 are of different sizes and shapes and/or are formed of differing materials. In one example, each stabilizing fin 18 is formed from a planar sheet of dense plastic to provide rigidity. As such, each stabilizing fin 18 is a planar body 90 of plastic defining a front surface 92 and a rear surface 94 opposite front surface 92. Each stabilizing fin 18 in substantially rectangular defining a perimeter edge 96 including an inside edge 98, an outside edge 100 opposite inside edge 98, a top edge 102 extending between inside edge 98 and outside edge 100, and a bottom edge 104 extending between inside edge 98 and outside edge 100 opposite top edge 102. In one example, one or more corners 108 of perimeter edge 96 of each stabilizing fin 18 is rounded so as not to present a sharp corner that could poke through garment 10 and/or cause discomfort to wearer of garment 10.

In one example, stabilizing fins 18 includes one or more front stabilizing fin 18A and one or more rear stabilizing fin 18B. In one embodiment, one front stabilizing fin 18A is sewn, adhered, or otherwise statically coupled to front surface 46 of first fastening tape 30, for example, along seam line 106. More specifically, in on example, rear surface 94 of stabilizing fin 18A is positioned to face toward, and in one instance, to be directly adjacent to, front surface 46 of first fastener tape 30 such that bottom edge 104 of stabilizing fin 18A is positioned to be substantially even with bottom edge 56 of first fastening tape 30. Inside edge 98 of front stabilizing fin 18A is positioned closest to first row of fastener elements 34, but is spaced from first row of fastener elements 34, for example, to be about half way between first longitudinal edge 50 and second longitudinal edge 52.

Front stabilizing fin 18A is sized with a fin width $W_F$, as measured between first inside edge 98 and outside edge 100, such that outside edge 100 is positioned to extend away from first inside edge 98 beyond second longitudinal edge 52. In one example, fin width $W_F$ of front stabilizing fin 18A is at least double a tape width $W_T$ of first fastening tape 30. Front stabilizing fin 18A is sized with a fin height $H_F$ measured between top edge 102 and bottom edge 104 to provide rigidity to first fastener tape 30, generally decreasing the flexible nature of first fastener tape 30. In one example, fin height $H_F$ is equal to or greater than a distance between bottom edge 56 of first fastener tape 30 and a fifth one of zipper teeth 58, measured from retainer pin 60, of first row of fastener elements 34. In one example, fin height $H_F$ is equal to at least 3 times, in one example, at least 4 times a retainer height $H_R$ of retainer box 40.

In one embodiment, one rear stabilizing fin 18B is sewn, adhered, or otherwise statically coupled to second surface 48 of first fastening tape 30. More specifically, in on example, front surface 92 of stabilizing fin 18B is positioned to face toward, and in one instance, to be directly adjacent to, rear surface 48 of first fastener tape 30. In one embodiment, rear stabilizing fin 18B and front stabilizing fin 18A are substantially identical in size and shape such that rear stabilizing fin 18B, like front stabilizing fin 18A has a fin height $H_F$ and a fin width $W_F$. In one example, rear stabilizing fin 18B and front stabilizing fin 18A and/or substantially identical in vertical and horizontal positioning as compared to first fastening tape 30, first row of fastener elements 34 and/or retainer box 40 such that perimeter edges 96 of front and rear stabilizing fins 18A and 18B align with one another. In one embodiment, one of first stabilizing fin 18A and second stabilizing fin 18B is eliminated from slidable closure 12.

In one example, another one of each of first stabilizing fin 18A and rear stabilizing fin 18B is coupled to second fastener tape 30 in a substantial mirrored manner about a center of slidable closure 12 as compared to the ones of first stabilizing fin 18A and rear stabilizing fin 18B that are coupled to first fastener tape 32. In one example, first stabilizing fin 18A and rear stabilizing fin 18B are coupled to second fastener tape 30 in any of the manners as described above for coupling first stabilizing fin 18A and rear stabilizing fin 18B to first fastener tape 30 except for in a mirrored manner about a center of slidable closure 12.

Figure 11:
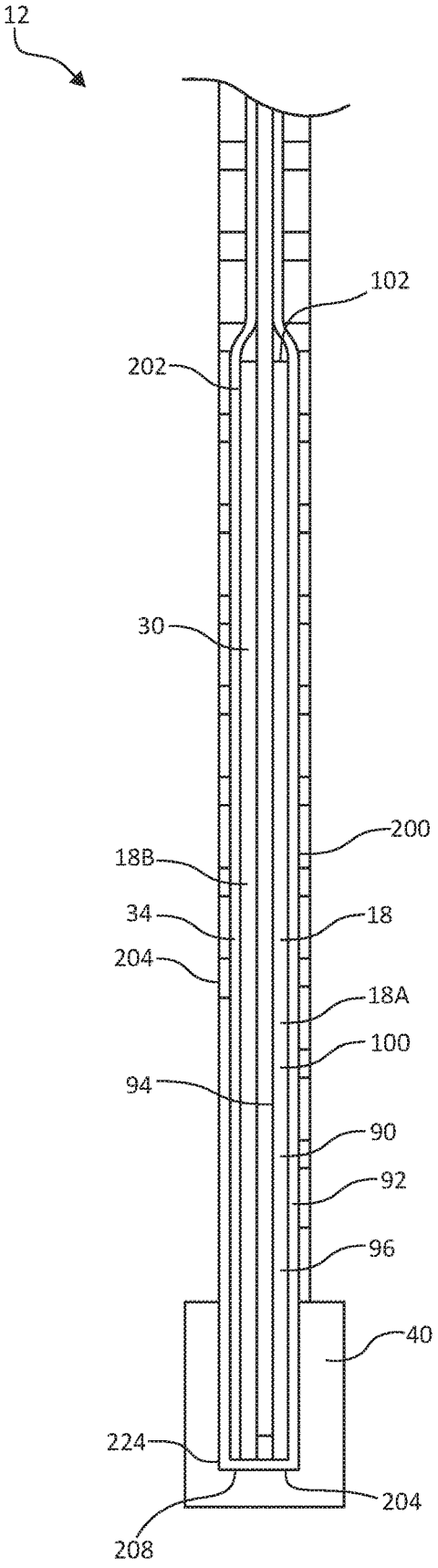
FIG. 11 is a cross-sectional view illustration taken along the line X-X in FIG. 2, according to one embodiment of the present invention.
Figure 12:
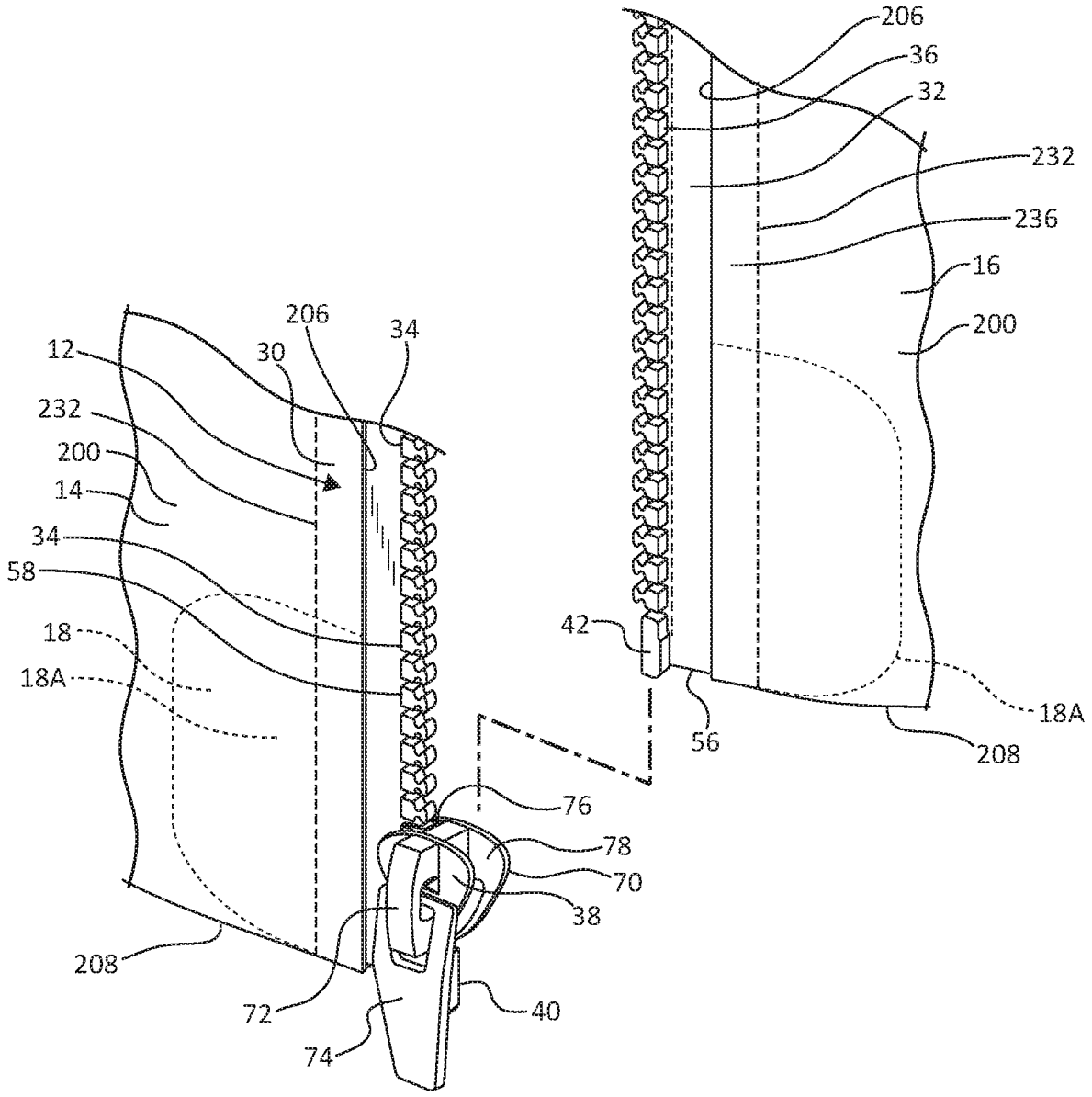
FIG. 12 is a front perspective view illustration of the slidable closure of FIG. 3 in a split configuration, according to one embodiment of the present invention.

FIGS. 2, 3, and 11 illustrate one embodiment of how slidable closure 12 is coupled to garment 10. In one example, garment 10 includes an outer fabric 200 and an inner fabric 202, such as a fabric similar to outer fabric 200 or a differing liner fabric. In one embodiment, inner fabric 202 is eliminated. In one embodiment, where inner fabric 202 is eliminated, outer fabric 200 includes a larger amount of outer fabric 200 that is illustrated in FIGS. 2 and 3 folded rearwardly about to cover reinforcing fins 18. In one example, an outer fabric 200 portion defining first front side 14 includes a bottom edge 204 and an inner edge 206 extending away from, and in one embodiment, perpendicularly away from, bottom edge 204. Inner edge 206 is folded over and sewn to front surface 46 first fastener tape 30 along a first or vertical seam line 232 spaced from first row of fastener elements 34 sufficiently to avoid inner edge 205 being entangled in coupling first row of fastening elements 34 with second row of fastening elements 36.

In one embodiment, inner edge 206 is folded over and sewn to front surface 46 first fastener tape 30 along a first or vertical seam line 232 at the same an inside edge 226 of inside fabric 202 is folded over and sewn to rear surface 48 of first fastener tap 30, for example, via the same vertical seam line 232. In this manner, both front reinforcing fin 18A and rear reinforcing fin 18B are enclosed between outer fabric 200 and inner fabric 202. In one example, each of outer fabric 200 and inner fabric 202 extend at least slightly nearer to first row of fastening elements 34 as compared to either of front reinforcing fin 18A and rear reinforcing fin 18B, such that outer fabric 200 and inner fabric 202 collectively entirely cover front reinforcing fin 18A and rear reinforcing fin 18B from view. In this manner, front reinforcing fin 18A and rear reinforcing fin 18B are not aesthetically interrupting to the design of garment 10 and, in one example, may not be detected until a wearer grasps garment 10 to close garment front and fees the added rigidity from front reinforcing fin 18A and rear reinforcing fin 18B.

Bottom edge 204 of outer fabric 200 is folded upwardly about fold line 208, which is, in one example, immediately adjacent bottom edges 104 of front reinforcing fin 18A and rear reinforcing fin 18B, over a bottom edge 224 of inner fabric 202 and secured thereto via horizontal seam line 234, according to one embodiment of the invention. In other embodiments, outer fabric 200 and inner fabric 202 are otherwise folded and/or coupled to first fastening tape 30 in any suitable manner substantially enclosing front reinforcing fin 18A and rear reinforcing fin 18B, as will be apparent to those of skill in the art upon reading this application.

Second front side 16 is coupled to second fastening tape 32 to cover the corresponding front reinforcing fin 18A and rear reinforcing fin 18B in a manner substantially identical to that described above for first front side 14 of garment 10 to cover the corresponding front reinforcing fin 18A and rear reinforcing fin 18B coupled thereto, but in a manner substantially mirrored left to right per the orientation of the figures.

Stabilizing fins 18 provide additional rigidity to portions of each of first front side 14 and second front side 16 of garment 10 adjacent a bottom of first fastener tape 30 and second fastener tape 32, respectively. The additional rigidity of first front side 14 and second front side 16 of garment 10 from stabilizing fins 18 decrease shifting of the fabric thereof, which makes it easier for a wearer or assistant to move insertion pin 42 into engagement with retainer box 40 to ready slidable closure 12 for coupling. The additional rigidity of first front side 14 and second front side 16 of garment 10 from stabilizing fins 18 also provides a larger area for a wearer to grasp in attempting to grasp each of insertion pin 42 and retainer box 40 to align and couple the same, which is particularly helpful for wearers having a low level of dexterity and/or wearers with gloves or mittens on their hands. More specifically, a wearer can manipulate insertion pin 42 and retainer box 40 by grasping any portion of garment 10 aligned with stabilizing fins 18 due to the rigidity between stabilizing fins 18 and insertion pin 42 and retainer box 40, respectively, which makes it easier for a wearer to move insertion pin 42 into engagement with retainer box 40 to ready slidable closure 12 for coupling. In one example, stabilizing fins 18 are not immovably rigid as they still allow for some flexibility to decrease any discomfort a wearer feels from stabilizing fins 18 when sitting, moving, bending, etc.

Once insertion pin 42 and retainer box 40 are coupled to one another, that is, slider 38 is pulled upwardly, for example, via pull 74, away from retainer box 40. Movement of slider 38 simultaneously pulls adjacent portions of first row of fastener element elements 34 a second row of fastener elements 36 together into interlocking engagement with each other to couple first font side 14 to second front side 16 closing garment 10. Subsequent pulling of pull 74 downwardly, moves slider 38 down to retainer box 40 disengaging first row of fastener elements 34 from second row of fastener elements 36 in a manner uncoupling first front side 14 from second front side 16 of garment 10.

Figure 13:
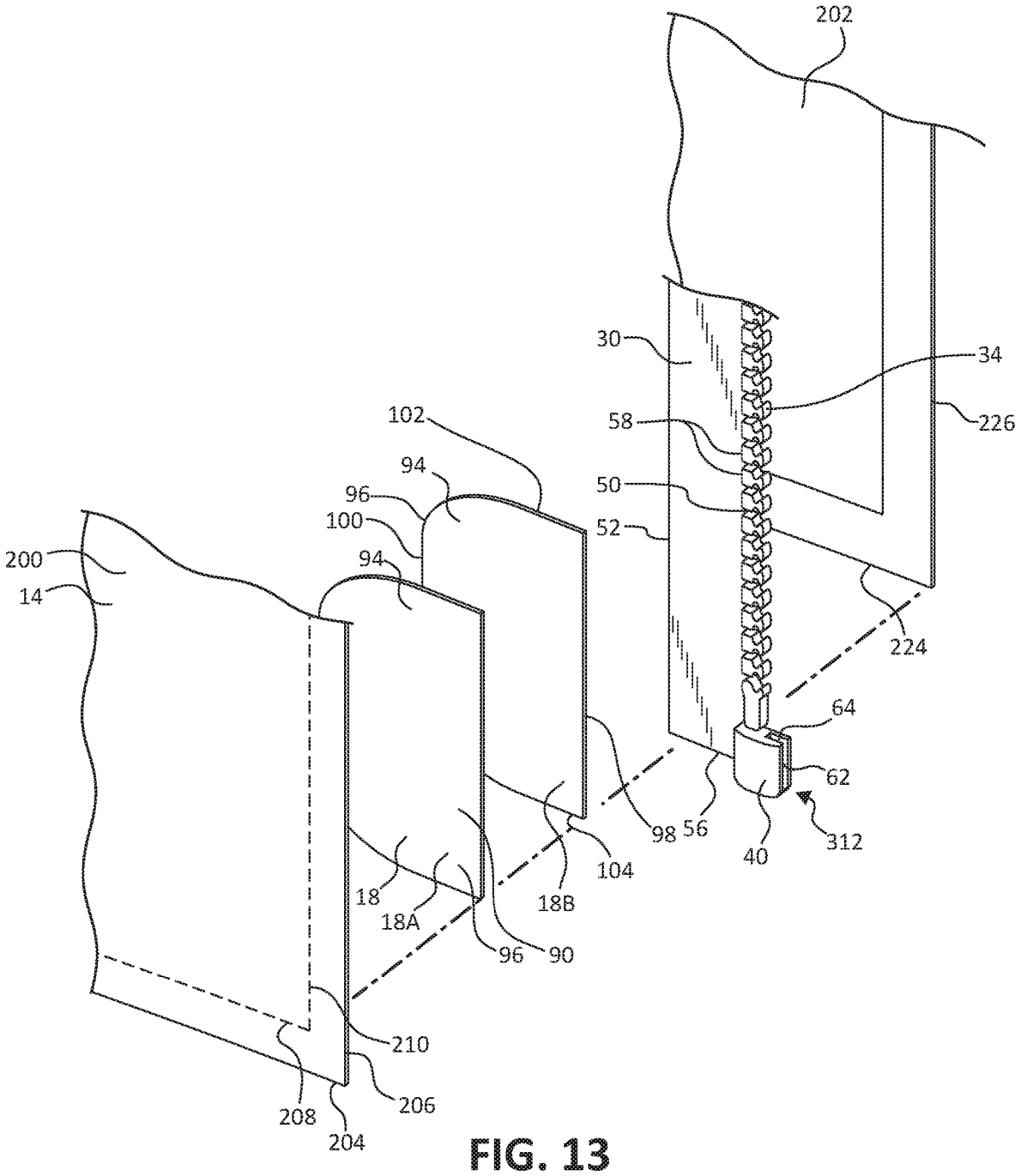
FIG. 13 is a front, perspective view illustration of a portion of a garment and a slidable closure, according to one embodiment of the present invention.
Figure 14:
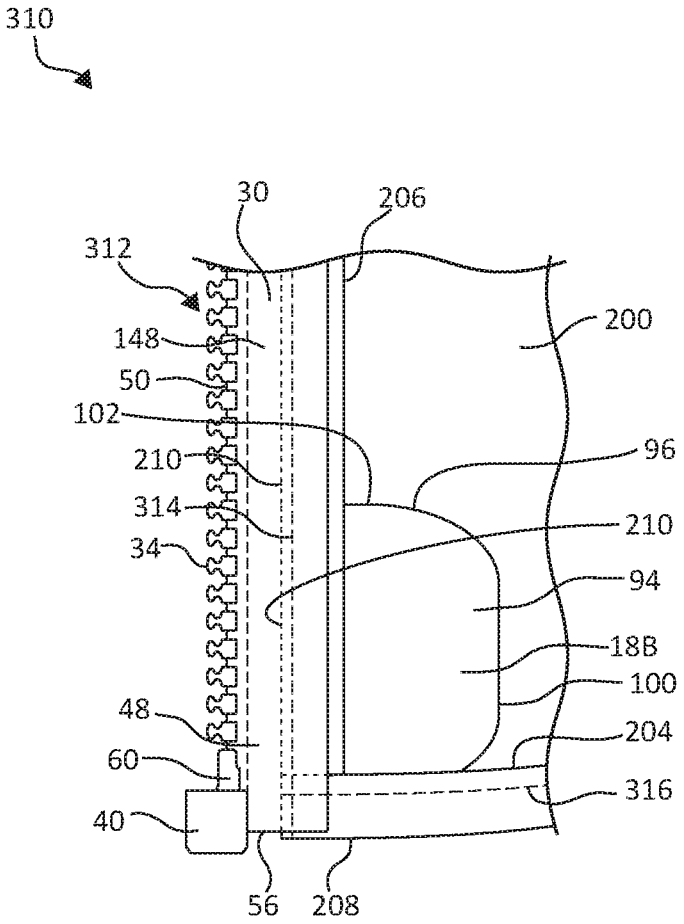
FIG. 14 is a partial rear view illustration of the garment and the slidable closure of FIG. 13, according to one embodiment of the present invention.

FIGS. 13 and 14 illustrate one embodiment of a garment 310 with a slidable closure 312. Garment 310 and slidable closure 312 are substantially identical to garment 10 and slidable closure 12 except were specifically described below as evident in part by the use of like reference numerals for elements thereof. Garment 310 includes outer fabric 200 and inner fabric 202, but coupled to slidable closure 312 in a different manner than garment 10. In particular, in one embodiment, outer fabric 200 includes a vertical fold line 210 inset from inside edge 206 and a horizontal fold line 208 inset from bottom edge 204. Front stabilizing fin 18A is positioned on an interior surface of outer fabric 200, for example, by placing rear surface 94 of front stabilizing fin 18A adjacent outer fabric 200 aligning inside edge 98 of front stabilizing fin 18A with vertical fold line 210 of outer fabric 200 and bottom edge 104 of front stabilizing fin 18A with bottom fold line 208. In one example, rear stabilizing fin 18B is placed adjacent front stabilizing fin 18A aligning perimeter edges 96 of front stabilizing fin 18A and perimeter edges of rear stabilizing fin 18B.

A portion of outer fabric 200 between vertical fold line 210 and inside edge 206 is folded rearwardly about vertical fold line 210 over inside edges 98 of stabilizing fins 18. A portion of outer fabric 200 between horizontal fold line 208 and bottom edge 204 is folded upwardly about horizontal fold line 208 over bottom edges 104 of stabilizing fins 18 as additionally illustrated in the rear view of FIG. 14, which shows garment 310 with inner fabric 202 removed for clarity. Outer fabric 200 folded over stabilizing fins 18 is placed on first fastener tape 34, more particularly, on front surface 46 to overlap second longitudinal edge 52 of first fastener tape 34.

Inside fabric 202, which in one embodiment is folded along its edges to provide a clean interior appearance, is aligned with outer fabric 200 and placed immediately adjacent rear surface 48 of first fastener tape. Vertical seam line 314 is sewn through outer fabric, stabilizing fins 18, first fastener tape 18, and inside fabric 202 in one embodiment to couple the same to one another. In one embodiment, horizontal seam line 316 is also sewn through outer fabric, stabilizing fins 18, first fastener tape 18, and inside fabric 202 in one embodiment to couple the same to one another. While in another embodiment, horizontal seam line 316 is moved down to be immediately adjacent folded bottom edge 208 and is only sewn through outer fabric 200 and inside fabric 202 as will be apparent to those of skill in the art upon reading the present application. Once assembled, garment 310 with slidable closure 312 functions similar to garment 10 and slidable closure 312 providing similar advantages to wearer of garment 310.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A slidable closure comprising:

a first fastener tape defining a first fastener tape bottom edge and a first fastener tape longitudinal edge;

a first row of fastener elements extending along the first fastener tape longitudinal edge;

a retainer box positioned near the first fastener tape bottom edge and adjacent a bottom fastener element of the first row of fastener elements;

a second fastener tape defining a second fastener tape bottom edge and a second fastener tape longitudinal edge;

a second row of fastener elements extending along the second fastener tape longitudinal edge and being configured to selectively interlock with the first row of fastener elements;

an insertion pin positioned near the second fastener tape bottom edge and adjacent a bottom fastener element of the second row of fastener elements; and a stabilizing fin being more rigid than the first fastener tape and being substantially planar, wherein the stabilizing fin is coupled with the first fastener tape to extend upwardly from the first fastener tape bottom edge, the stabilizing fin defines a first edge closest to the first row of fastener elements, and the first edge is spaced from the first row of fastener elements and from the retainer box;

wherein the stabilizing fin is sewn to the first fastener tape to couple the stabilizing fin to the first fastener tape.

2. The slidable closure of claim 1, wherein:

the first fastener tape defines a first surface and a second surface opposite the first surface, and the stabilizing fin defines a first substantially planar surface positioned directly adjacent to the first surface of the first fastener tape.

3. The slidable closure of claim 1, wherein the stabilizing fin has a width greater than a width of the first fastener tape.

4. The slidable closure of claim 1, wherein the stabilizing fin has a fin height at least six times a retainer box height of the retainer box.

5. The slidable closure of claim 1, wherein:

the stabilizing fin is a first stabilizing fin, the slidable closure further comprising a second stabilizing fin, and the second stabilizing fin is more rigid than the second fastener tape, is substantially planar, is coupled with the second fastener tape to extend upwardly from the second fastener tape bottom edge, and defines a second fin longitudinal edge closest to the second row of fastener elements and spaced from the second row of fastener elements and from the insertion pin.

6. The slidable closure of claim 1, wherein:

the first fastener tape defines a front surface and a rear surface opposite the front surface;

the stabilizing fin is a first stabilizing fin coupled with the front surface of the first fastener tape, the slidable closure further comprising a second stabilizing fin, and the second stabilizing fin is more rigid than the first fastener tape, is substantially planar, is coupled with the rear surface of the first fastener tape to extend upwardly from the first fastener tape bottom edge, and defines a second fin longitudinal edge closest to the first row of fastener elements and spaced from the first row of fastener elements and from the retainer box.

7. The slidable closure of claim 6, wherein the first stabilizing fin and the second stabilizing fin are separate from one another.

8. The slidable closure of claim 6, wherein the first stabilizing fin extends substantially parallel with the second stabilizing fin.

9. The slidable closure of claim 6, wherein:

the slidable closure further comprises a third stabilizing fin, and the third stabilizing fin is more rigid than the second fastener tape, is substantially planar, is coupled with the second fastener tape to extend upwardly from the second fastener tape bottom edge, and defines a longitudinal edge closest to the second row of fastener elements and spaced from the second row of fastener elements.

10. A combination comprising:

a slidable closure comprising:

a first fastener tape defining a first fastener tape bottom edge and a first fastener tape longitudinal edge, a first row of fastener elements extending along the first fastener tape longitudinal edge, a retainer box positioned near the first fastener tape bottom edge and adjacent a bottom fastener element of the first row of fastener elements, a second fastener tape defining a second fastener tape bottom edge and a second fastener tape longitudinal edge, a second row of fastener elements extending along the second fastener tape longitudinal edge and being configured to selectively interlock with the first row of fastener elements, an insertion pin positioned near the second fastener tape bottom edge and adjacent a bottom fastener element of the second row of fastener elements, and a stabilizing fin being more rigid than the first fastener tape and being substantially planar, wherein the stabilizing fin is coupled with the first fastener tape to extend upwardly from the first fastener tape bottom edge, the stabilizing fin defines a first edge closest to the first row of fastener elements, and the first edge is spaced from the first row of fastener elements and from the retainer box; and a fabric article, the fabric article being sewn to the first fastener tape and covering the stabilizing fin.

11. The combination of claim 10, wherein the fabric article is sewn to the first fastener tape and the stabilizing fin via a common seam sewn through the fabric article, the first fastener tape, and the stabilizing fin.

12. A combination comprising:

a slidable closure comprising:

a first fastener tape defining a first fastener tape bottom edge and a first fastener tape longitudinal edge, a first row of fastener elements extending along the first fastener tape longitudinal edge, a retainer box positioned near the first fastener tape bottom edge and adjacent a bottom fastener element of the first row of fastener elements, a second fastener tape defining a second fastener tape bottom edge and a second fastener tape longitudinal edge, a second row of fastener elements extending along the second fastener tape longitudinal edge and being configured to selectively interlock with the first row of fastener elements, an insertion pin positioned near the second fastener tape bottom edge and adjacent a bottom fastener element of the second row of fastener elements, and a stabilizing fin being more rigid than the first fastener tape and being substantially planar, wherein the stabilizing fin is coupled with the first fastener tape to extend upwardly from the first fastener tape bottom edge, the stabilizing fin defines a first edge closest to the first row of fastener elements, and the first edge is spaced from the first row of fastener elements and from the retainer box; and a fabric article, the fabric article being sewn with the first fastener tape and enclosing the stabilizing fin.

13. A slidable closure comprising:

a first fastener tape defining a first fastener tape bottom edge and a first fastener tape longitudinal edge;

a first row of fastener elements extending along the first fastener tape longitudinal edge;

a retainer box positioned near the first fastener tape bottom edge and adjacent a bottom fastener element of the first row of fastener elements;

a second fastener tape defining a second fastener tape bottom edge and a second fastener tape longitudinal edge;

a second row of fastener elements extending along the second fastener tape longitudinal edge and being configured to selectively interlock with the first row of fastener elements;

an insertion pin positioned near the second fastener tape bottom edge and adjacent a bottom fastener element of the second row of fastener elements; and a stabilizing fin being more rigid than the first fastener tape and being substantially planar, wherein the stabilizing fin is coupled with the first fastener tape to extend upwardly from the first fastener tape bottom edge, the stabilizing fin defines a first edge closest to the first row of fastener elements, and the first edge is spaced from the first row of fastener elements and from the retainer box;

wherein:

the stabilizing fin is a first stabilizing fin, the slidable closure further comprising a second stabilizing fin, and the second stabilizing fin is substantially planar, is positioned adjacent the first stabilizing fin, and is sewn to the first fastener tape with the first stabilizing fin.

14. The slidable closure of claim 13, in combination with a fabric article, the fabric article being folded over the first stabilizing fin and the second stabilizing fin, and a seam sewn through two layers of the fabric article, the first stabilizing fin, the second stabilizing fin, and the first fastener tape to couple the fabric article, the first stabilizing fin, and the second stabilizing fin to the first fastener tape.

15. The slidable closure of claim 14, wherein bottom edges of the first stabilizing fin and the second stabilizing fin are positioned adjacent a bottom of the fabric article.

16. A fabric article comprising:

a first front side formed of fabric;

a second front side formed of fabric; and a slidable closure comprising:

a first fastener tape defining a first fastener tape bottom edge and a first fastener tape longitudinal edge, the first fastener tape being sewn to the first front side of the fabric, a first row of fastener elements extending along the first fastener tape longitudinal edge, a retainer box positioned near the first fastener tape bottom edge and adjacent a bottom fastener element of the first row of fastener elements, a second fastener tape defining a second fastener tape bottom edge and a second fastener tape longitudinal edge, the second fastener tape being sewn to the second front side of the fabric, a second row of fastener elements extending along the second fastener tape longitudinal edge and being configured to selectively interlock with the first row of fastener elements, an insertion pin positioned near the second fastener tape bottom edge and adjacent a bottom fastener element of the second row of fastener elements, and a stabilizing fin being more rigid than the first fastener tape and being substantially planar, wherein the stabilizing fin is coupled with the first fastener tape to extend upwardly from the first fastener tape bottom edge, the stabilizing fin defines a first edge closest to the first row of fastener elements, and the first edge is spaced from the first row of fastener elements and from the retainer box;

wherein the first front side covers the stabilizing fin from view.

17. The fabric article of claim 16, wherein the stabilizing fin is formed from a substantially planar dense plastic.

18. A fabric article comprising:

a first front side formed of fabric;

a second front side formed of fabric; and a slidable closure comprising:

a first fastener tape defining a first fastener tape bottom edge and a first fastener tape longitudinal edge, the first fastener tape being sewn to the first front side of the fabric, a first row of fastener elements extending along the first fastener tape longitudinal edge, a retainer box positioned near the first fastener tape bottom edge and adjacent a bottom fastener element of the first row of fastener elements, a second fastener tape defining a second fastener tape bottom edge and a second fastener tape longitudinal edge, the second fastener tape being sewn to the second front side of the fabric, a second row of fastener elements extending along the second fastener tape longitudinal edge and being configured to selectively interlock with the first row of fastener elements, an insertion pin positioned near the second fastener tape bottom edge and adjacent a bottom fastener element of the second row of fastener elements, and a stabilizing fin being more rigid than the first fastener tape and being substantially planar, wherein the stabilizing fin is coupled with the first fastener tape to extend upwardly from the first fastener tape bottom edge, the stabilizing fin defines a first edge closest to the first row of fastener elements, and the first edge is spaced from the first row of fastener elements and from the retainer box;

wherein the first front side encloses the stabilizing fin.

* * * * *